US012601069B2

(12) United States Patent
Park et al.

(10) Patent No.: US 12,601,069 B2
(45) Date of Patent: Apr. 14, 2026

(54) MEMBRANE ELECTRODE ASSEMBLY FOR HYDROGEN PRODUCTION, ELECTROCHEMICAL CELL COMPRISING THE SAME, AND METHOD FOR HYDROGEN PRODUCTION USING THE SAME

(71) Applicant: KOREA INSTITUTE OF SCIENCE AND TECHNOLOGY, Seoul (KR)

(72) Inventors: Hyun S. Park, Seoul (KR); Jong Hyun Jang, Seoul (KR); Jihyun Choi, Seoul (KR); Chaekyung Baik, Seoul (KR); Jimin Kong, Seoul (KR); Hyuntae Sohn, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 0 days.

(21) Appl. No.: 18/955,621

(22) Filed: Nov. 21, 2024

(65) Prior Publication Data

US 2025/0313969 A1 Oct. 9, 2025

(30) Foreign Application Priority Data

Apr. 3, 2024 (KR) ..... 10-2024-0045471

(51) Int. Cl.

| | |
|---|---|
| ***C25B 9/23*** | (2021.01) |
| ***C25B 1/02*** | (2006.01) |
| ***C25B 11/081*** | (2021.01) |
| ***C25B 15/02*** | (2021.01) |
| ***C25B 15/08*** | (2006.01) |

(52) U.S. Cl.

CPC ..... *C25B 9/23* (2021.01); *C25B 1/02* (2013.01); *C25B 11/081* (2021.01); *C25B 15/02* (2013.01); *C25B 15/08* (2013.01)

(58) Field of Classification Search

None

See application file for complete search history.

(56) References Cited

FOREIGN PATENT DOCUMENTS

| | | | | |
|---|---|---|---|---|
| JP | 2010-126769 | A | 6/2010 | |
| KR | 10-2022-0068566 | A | 5/2022 | |
| KR | 10-2022-0155727 | A | 11/2022 | |
| KR | 10-2508245 | B1 | 3/2023 | |
| KR | 10-2023-0098153 | A | 7/2023 | |
| KR | 10-2023-0100715 | A | 7/2023 | |
| KR | 10-2555530 | B1 | 7/2023 | |
| KR | 10-2023-0115500 | A | 8/2023 | |
| WO | WO-2009024185 | A1 * | 2/2009 | ..... C25B 1/00 |
| WO | 2022/010863 | A1 | 1/2022 | |
| WO | 2022/096529 | A1 | 5/2022 | |

OTHER PUBLICATIONS

IKA (https://www.ika.com/electrasyn/Fundamentals) (Year: 2021).*

Request for the Submission of an Opinion for Korean Patent Application No. 10-2024-0045471, dated Nov. 11, 2025.

* cited by examiner

*Primary Examiner* — Wojciech Haske

(57) ABSTRACT

This specification relates to a membrane electrode assembly for hydrogen production, an electrochemical cell comprising the same, and a method for hydrogen production using the same. According to an embodiment of the present invention, the membrane electrode assembly for hydrogen production, the electrochemical cell comprising the same, and the method for hydrogen production using the same can improve ammonia electrolysis durability by preventing performance degradation due to catalyst poisoning and restoring the performance.

8 Claims, 21 Drawing Sheets

MEMBRANE ELECTRODE ASSEMBLY FOR HYDROGEN PRODUCTION, ELECTROCHEMICAL CELL COMPRISING THE SAME, AND METHOD FOR HYDROGEN PRODUCTION USING THE SAME

DESCRIPTION OF GOVERNMENT-SPONSORED RESEARCH

This invention was carried out with the support of the Ministry of Science and ICT under a research project of Unique Project identification number: 1711203714 and Project identification number: 2E32590 titled "Development of green hydrogen production-liquid storage integration technology", as part of the research project of "Support for research and operation expenses (Main Project Cost)" managed by the Korea Institute of Science and Technology from Jan. 1 to Dec. 31, 2023.

This invention was carried out with the support of the Ministry of Science and ICT under a research project of Unique Project identification number: 1055001318 and Project identification number: 2022M3I3A1081901 titled "Development of a large-capacity water-based ammonia electrolysis system for high-efficiency hydrogen extraction", as part of the research project of "Development of future hydrogen source technology" managed by the National Research Foundation of Korea from Jan. 1 to Dec. 31, 2023.

CROSS REFERENCE TO RELATED APPLICATION

The present application claims the priority of Korean Patent Application No. 10-2024-0045471 filed on Apr. 3, 2024, the entire contents of which are incorporated herein by reference.

BACKGROUND OF THE INVENTION

Field of the Invention

Disclosed herein is a membrane electrode assembly for hydrogen production, an electrochemical cell comprising the same, and a method for hydrogen production using the same.

Description of the Related Art

Ammonia has the lowest oxidation state among nitrogen compounds and may be generated either directly from various industrial processes or through the cycle of nitrogen compounds during the treatment of nitrate nitrogen compounds. The ammonia can be treated by methods of degassing, biological decomposition, chlorine decomposition, and electrochemical decomposition. Among them, the electrochemical oxidation treatment method has recently received much attention due to its characteristics such as economic feasibility, speed and simplicity of the operation, and minimal generation of the secondary waste. There is pyrolysis technology as a previously known method for hydrogen production using ammonia as a raw material, and Korean Patent Registration No. 10-2555530 discloses a method of producing hydrogen by sequentially performing pyrolysis and carbon dioxide conversion reactions using heat generated from a combustor. However, since nitrogen and hydrogen are generated simultaneously, high-purity hydrogen must be separated using an expensive palladium membrane, which results in having the limitation of low productivity and economic feasibility. In addition, when the ammonia is decomposed by the electrolytic method, if a separation membrane is not used, either intermediate products during the ammonia oxidation process at an anode are re-reduced by substances generated at a cathode, or ammonia decomposition products generated at the anode are re-reduced at the cathode, thereby causing lower efficiency of the overall ammonia electrolytic decomposition. Therefore, it is necessary to perform the electrolytic decomposition using the separation membrane that separates the cathode and the anode.

SUMMARY OF THE INVENTION

A purpose according to an aspect of the present invention is to provide a membrane electrode assembly for hydrogen production that can improve ammonia electrolysis durability by preventing performance degradation due to catalyst poisoning and restoring the performance, an electrochemical cell comprising the same, and a method for hydrogen production using the same.

In an aspect of the present invention, the present invention provides a membrane electrode assembly for hydrogen production, comprising: an anion exchange membrane; a cathode located on one side of the anion exchange membrane; and an anode located on the other side of the anion exchange membrane, wherein the anode includes an alkaline electrolyte containing an aqueous ammonia solution and an anode catalyst, and further comprising a current-voltage control device that performs pulse operation by applying a constant voltage to the anode.

In an aspect of the present invention, the present invention provides an electrochemical cell for hydrogen production, comprising the membrane electrode assembly for hydrogen production.

In an aspect of the invention, the invention provides a method for hydrogen production, comprising the steps of: delivering ammonia to an anode of an electrochemical cell for hydrogen production; oxidizing the ammonia at the anode to decompose it into water, nitrogen, and electrons; transferring the electrons from the anode to a cathode; and producing substantially pure hydrogen by the electrons at the cathode, and further comprising the step of performing pulse operation by applying a constant voltage to the anode by a current-voltage control device.

According to an embodiment of the present invention, the membrane electrode assembly for hydrogen production, the electrochemical cell comprising the same, and the method for hydrogen production using the same can improve ammonia electrolysis durability by preventing performance degradation due to catalyst poisoning and restoring the performance.

DETAILED DESCRIPTION OF THE INVENTION

Figure 1:
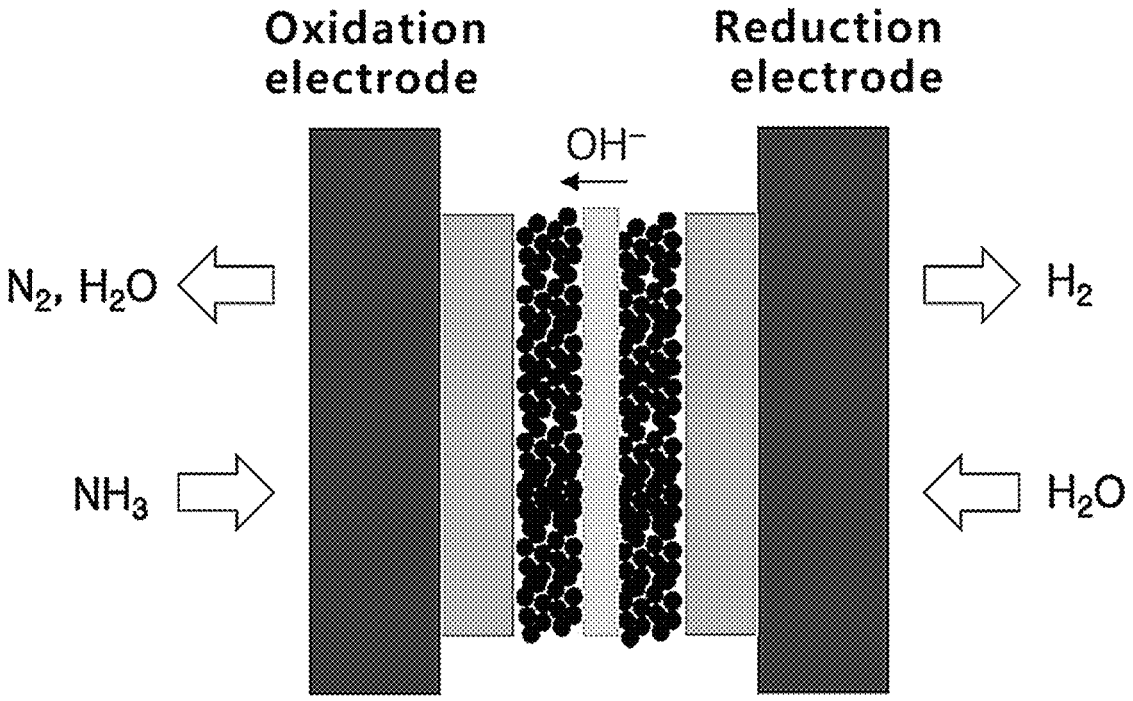
FIG. 1 is a schematic diagram showing a membrane electrode assembly for hydrogen production according to an embodiment of the present invention.

Hereinafter, preferred embodiments of the present invention will be described in detail with reference to the attached drawings.

Since the embodiments of the present invention disclosed in the specification are illustrative only for description purposes, they can be implemented in various forms and should not be construed as being limited to the embodiments described in the specification. The present invention may make various changes and take various forms, and the embodiments are not intended to limit the present invention to the specifically disclosed forms. Accordingly, they should be understood to cover all changes, equivalents, or substitutes included in the spirit and technical scope of the present invention.

In this specification, in case a part "includes" a certain constitutive element, this means that it may further include other constitutive elements rather than excluding the other constitutive elements, unless specifically stated to the contrary.

Throughout the specification, similar parts are given the same reference numerals. In the entire specification, in case a part such as a layer, a membrane, a region, plate, etc. is said to be "on" or "over" other part, this includes not only the case where it is located directly above the other part, but also the case where another part is interposed between them. Throughout the specification, the terms such as first and second may be used to explain various constitutive elements, but such constitutive elements should not be limited by the terms. These terms are used only to distinguish one constitutive element from the other constitutive element.

Membrane Electrode Assembly for Hydrogen Production

In an aspect of the present invention, the present invention provides a membrane electrode assembly for hydrogen production, comprising: an anion exchange membrane; a cathode located on one side of the anion exchange membrane; and an anode located on the other side of the anion exchange membrane, wherein the anode includes an alkaline electrolyte containing an aqueous ammonia solution and an anode catalyst, and further comprising a current-voltage control device that performs pulse operation by applying a constant voltage to the anode.

The hydrogen is attracting attention as a renewable energy source with no carbon emissions, but has a disadvantage of requiring complex facilities or processes for its storage and transportation due to the high storage and transportation costs of liquefied hydrogen and high-pressure hydrogen. Accordingly, ammonia, which is easy to store and transport, is used as a storage medium for the hydrogen. Whereas the hydrogen requires liquefaction conditions of high pressure (700 bar) or ultra-low temperature (−253° C.), the ammonia has an advantage in that it can be liquefied and transported at relatively low pressure (8 bar) even at a room temperature and has a higher energy density in a volume compared to the liquefied hydrogen ($H_2$: 1.4 kWh/L; $NH_3$: 3.2 kWh/L). In case the ammonia is used as the hydrogen storage medium, a process of extracting the hydrogen by reforming (or cracking) the ammonia is required.

Since production of ammonia electrolytic hydrogen through the membrane electrode assembly can be drived at a low temperature of 100° C. or less, it has an advantage of not requiring additional purification and separation processes for hydrogen and nitrogen, but has a problem of a rapid performance deterioration and low durability due to poisoning of a catalyst surface during ammonia electrolysis operation. Accordingly, the present inventors have completed the present invention by discovering that ammonia electrolysis durability can be improved by preventing performance degradation due to the catalyst poisoning and restoring the performance when pulse operation is carried out by applying a constant voltage to the anode.

FIG. 1 is a schematic diagram showing a membrane electrode assembly for hydrogen production according to an embodiment of the present invention. The membrane electrode assembly for hydrogen production according to an embodiment of the present invention as shown in FIG. 1 comprises an anion exchange membrane, a cathode (reduction electrode) located on one side of the anion exchange membrane, and an anode (oxidation electrode) located on the other side of the anion exchange membrane.

In an embodiment, the anode catalyst is a catalyst for ammonia oxidation reaction (AOR). The ammonia oxidation reaction (AOR) performed at the anode is shown in Reaction Equation 1 below.

[Reaction Equation 1]

$$2NH_3 + 6OH^- \longrightarrow N_2 + 6H_2O + 6e^-$$

In an embodiment, the cathode includes an alkaline electrolyte and a cathode catalyst, and the cathode catalyst is a hydrogen evolution reaction catalyst. At the cathode, the electrons generate substantially pure hydrogen. The hydrogen generation reaction performed at the cathode is shown in Reaction Equation 2 below.

[Reaction Equation 2]

$$6H_2O + 6e^- \longrightarrow 3H_2 + 6OH^-$$

In an embodiment, in case the ammonia oxidation reaction is performed without using the anion exchange membrane, either an intermediate product during the ammonia oxidation process at the anode is re-reduced by a substance generated at the cathode, or the ammonia decomposition product generated at the cathode is re-reduced at the anode, thereby causing a problem in that an overall efficiency of the ammonia electrolytic decomposition is lowered.

In an embodiment, the cathode catalyst contains one or more selected from the group consisting of a metal foam, a thin metal film, a carbon paper, a carbon fiber, a carbon felt, a carbon cloth, and a platinum catalyst.

In an embodiment, the anode catalyst contains one or more metals selected from the group consisting of platinum (Pt), iridium (Ir), rhodium (Rh), ruthenium (Ru), iron (Fe), cobalt (Co), nickel (Ni), and copper (Cu).

In an embodiment, the membrane electrode assembly further comprises a cycling injection device that circulates and injects a poisoning removal solution on order to prevent poisoning of the anode catalyst into the anode. The present inventors also completed the present invention by discovering that the ammonia electrolysis durability can be improved by removing catalyst poisoning due to nitrogen species by further comprising a performance recovery (wash) process of circulating and injecting the poisoning removal solution.

In an embodiment, the poisoning removal solution is basic, neutral, or acidic and does not contain ammonia. In an embodiment, the neutral poisoning removal solution is distilled water, wherein the distilled water is at least one of primary distilled water that has been subjected to a distillation process, secondary distilled water that has passed through an ion filter, and tertiary distilled water (ultra-pure water) that is pure distilled water that has passed through a semi-permeable membrane. In an embodiment, the basic poisoning removal solution has a pH of 8 to 14, and the basic solution is potassium hydroxide or sodium hydroxide. The acidic poisoning removal solution has a pH of 1 to 6, and the acidic solution is a hydrochloric acid solution or a sulfuric acid solution. However, the poisoning removal solution with a pH of 2 or less may damage the membrane.

Electrochemical Cell for Hydrogen Production

In an aspect of the present invention, the present invention provides an electrochemical cell for hydrogen production, comprising a membrane electrode assembly for hydrogen production.

The electrochemical cell is used in an electrolysis cell that produces gas using water as an electrolyte and a raw material, and a fuel cell that produces electricity using fuel. The electrochemical cell is composed of a membrane electrode assembly, a frame arranged in the form capable of supplying and discharging electrons, reactants, and products, a separator, a membrane electrode assembly support, and a gasket (packing). The electrochemical cell for hydrogen production according to an embodiment of the present invention must meet the conditions of excellent electrolysis performance, excellent durability, and low price.

Method for Hydrogen Production

In an aspect of the invention, the invention provides a method for hydrogen production, comprising the steps of: delivering ammonia to an anode of an electrochemical cell for hydrogen production; oxidizing the ammonia at the anode to decompose it into water, nitrogen, and electrons; transferring the electrons from the anode to a cathode; and producing substantially pure hydrogen by the electrons at the cathode, and further comprising the step of performing pulse operation by applying a constant voltage to the anode by a current-voltage control device.

The present inventors completed the present invention by discovering that ammonia electrolysis durability can be improved by preventing performance degradation due to catalyst poisoning and restoring the performance when the pulse operation is performed by applying the constant voltage to the anode.

In an embodiment, the pulse operation is repeatedly performed when an average potential of the electrochemical cell for hydrogen production is in a first potential range at a first pulse operation and is in a second potential range at a second pulse operation. In an embodiment, the first potential range is from 0.5V to 0.9V, and the second potential range is from −1.0V to 0V. In an embodiment, the pulse operation is repeatedly performed when the average potential of the electrochemical cell for hydrogen production is in the ranges of 0.5V to 0.9V and −1.0V to 0V.

In an embodiment, the first potential range at the first pulse operation may be 0.5V or more, 0.55V or more, 0.6V or more, 0.65V or more, or 0.7V or more; and 0.9V or less, 0.85V or less, 0.8V or less, 0.75V or less, or 0.7V or less, but is not limited thereto.

In an embodiment, the second potential range at the second pulse operation may be −1.0V or more, −0.9V or more, −0.8V or more, −0.7V or more, −0.6V or more, or −0.5V or more; and 0V or less, −0.1V or less, −0.2V or less, −0.3V or less, −0.4V or less, or −0.5V or less, but is not limited thereto.

In an embodiment, the pulse operation is repeatedly performed when the average potential of the electrochemical cell for hydrogen production is in a positive voltage range and a negative voltage range. When the second potential is in the negative voltage range, durability against catalyst poisoning before and after the pulse operation is improved and performance degradation is reduced.

In an embodiment, the first pulse operation time is 10 seconds to 30 seconds, and the second pulse operation time is 5 seconds to 15 seconds. In an embodiment, the pulse operation is repeatedly carried out for 10 seconds to 30 seconds when the average potential of the electrochemical cell for hydrogen production is in the range of 0.5V to 0.9V, and is repeatedly carried out for 5 seconds to 15 seconds when the average potential is in the range of −1.0V to 0V.

In an embodiment, the first pulse operation time may be 10 seconds or more, 11 seconds or more, 12 seconds or more, 13 seconds or more, 14 seconds or more, 15 seconds or more, 16 seconds or more, 17 seconds or more, 18 seconds or more, 19 seconds or more, or 20 seconds or more; and 30 seconds or less, 29 seconds or less, 28 seconds or less, 27 seconds or less, 26 seconds or less, 25 seconds or less, 24 seconds or less, 23 seconds or less, 22 seconds or less, 21 seconds or less, or 20 seconds or less, but is not limited thereto.

In an embodiment, the second pulse operation time may be 5 seconds or more, 6 seconds or more, 7 seconds or more, 8 seconds or more, 9 seconds or more, or 10 seconds or longer; and 15 seconds or less, 14 seconds or less, 13 seconds or less, 12 seconds or less, 11 seconds or less, or 10 seconds or less, but is not limited thereto.

In an embodiment, the method further comprises the step of circulating and injecting into the anode a poisoning removal solution for preventing poisoning of the anode catalyst by s cycling injection device after performing the pulse operation. The present inventors also completed the present invention by discovering that ammonia electrolysis durability can be improved by removing catalyst poisoning due to nitrogen species by further comprising a performance recovery (wash) process that circulates and injects the poisoning removal solution.

In an embodiment, the poisoning removal solution is basic, neutral, or acidic and does not contain ammonia. In an embodiment, the neutral poisoning removal solution is distilled water, wherein the distilled water is at least one of primary distilled water that has been subjected to a distillation process, secondary distilled water that has passed through an ion filter, and tertiary distilled water (ultra-pure water) that is pure distilled water that has passed through a semi-permeable membrane. The basic poisoning removal solution has a pH of 8 to 14, and the basic solution is potassium hydroxide or sodium hydroxide. In an embodiment, the acidic poisoning removal solution has a pH of 1 to 6, and the acidic solution is a hydrochloric acid solution or a sulfuric acid solution. However, the removal solutions with a pH of 2 or lower may damage the membrane to cause the performance degradation.

In an embodiment, the step of performing the pulse operation is proceeded with at least once or more.

In an embodiment, the step of performing the pulse operation and the step of circulating and injecting the poisoning removal solution are proceeded with at least once or more.

In an embodiment, the method further comprises the step of applying a cycling voltage to the anode by the current-voltage control device after circulating and injecting the poisoning removal solution, wherein the cycling voltage includes a negative reduction voltage. In recovering the catalyst poisoning, in addition to the circulation of the poisoning removal solution, the negative reduction voltage is then applied to exert a synergistic effect.

Hereinafter, the present invention will be described in detail with reference to preferred Examples so that those skilled in the art can easily practice the invention. However, the present invention may be implemented in various different forms and is not limited to Examples described herein.

EXAMPLES

<Preparation Example 1> Preparation of Membrane Electrode Assembly for Hydrogen Production A gas diffusion electrode (GDE) coated with a catalyst layer was prepared by spraying an anode catalyst ink and a cathode catalyst ink each containing platinum (Pt) onto a gas diffusion layer. A membrane electrode assembly for hydrogen production was prepared by bonding an anion exchange membrane (Sustainion® X37-50 Grade RT), which was activated by soaking in a 1M KOH solution for 24 hours, together with the anode gas diffusion layer (GDL) and cathode gas diffusion layer (GDL) coated with the catalyst layer.

<Preparation Example 2> Preparation of Electrochemical Cell for Hydrogen Production An electrochemical cell for hydrogen production was prepared by arranging a flow path through which water, ammonia, hydrogen, and oxygen can be supplied and discharged, to the membrane electrode assembly for hydrogen production prepared in Preparation Example 1.

<Driving Example 1> Driving Electrochemical Cell for Hydrogen Production

In order to confirm ammonia electrolysis and hydrogen production performances, the electrochemical cell for hydrogen production prepared in Preparation Example 2 was operated at 60° C. using an ammonia ($NH_3$) solution at the anode and a potassium hydroxide (KOH) solution at the cathode. Next, the electrochemical cell was drived using different driving methods.

Operation Example 1 was operated by chronoamperometry (CA), and a constant voltage of 0.7V was applied for 2000 seconds.

Operation Example 2 was operated by pulse operation (Pulse; P), and 100 cycles were performed for 20 seconds at an average potential of 0.7 V and for 10 seconds at an average potential of 0 V using a current-voltage control device.

Operation Example 3 was operated by pulse operation (P), and 100 cycles were performed for 20 seconds at an average potential of 0.7 V and for 10 seconds at an average potential of −0.5 V using a current-voltage control device.

Operation Example 4 further included a process (Wash; W) of circulating and injecting a poisoning removal solution so as to restore performance after the pulse operation (Pulse; P). The process (Wash; W) of circulating and injecting the poisoning removal solution was carried out by flowing distilled water on both electrodes at 60° C. for a sufficient period of time of 30 minutes or more.

<Reference Example 1> Method for Confirming Ammonia Electrolysis and Hydrogen Production Performances Ammonia electrolysis and hydrogen production performances of the electrochemical cell were confirmed by performing chronoamperometry (CA) at 0.7 V and cyclic voltammetry (CV) from −0.5 V to 1.0 V at 100 mV/s.

<Experimental Example 1> Performance Confirmation of Electrochemical Cell for Hydrogen Production 1 (Comparison of Constant Voltage Operation and Pulse Operation)

Figure 2:
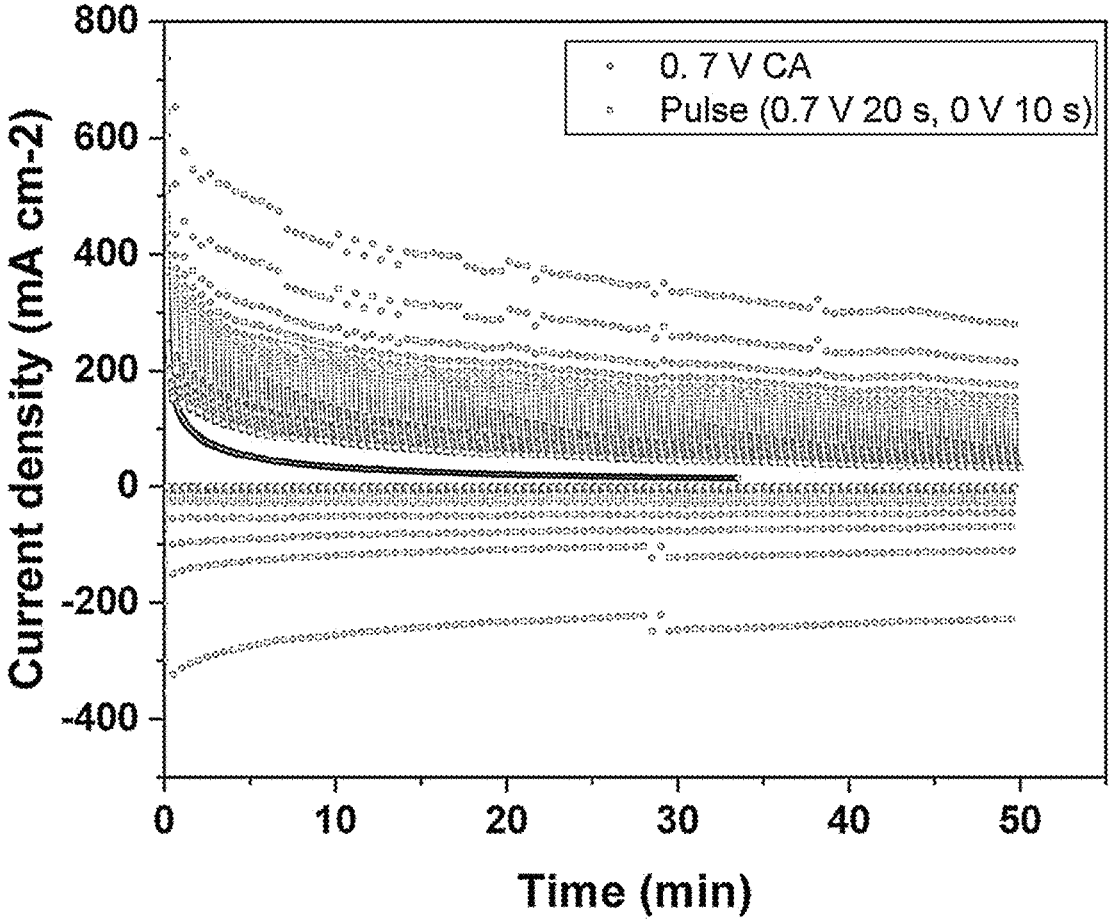
FIG. 2 is a graph showing a chronoamperometric (CA) curve of an electrochemical cell for hydrogen production according to an embodiment of the present invention.

Ammonia electrolysis and hydrogen production performances were confirmed for the electrochemical cells for hydrogen production of Operation Example 1 and Operation Example 2. The applied time was fixed at 2000 seconds. FIG. 2 is a graph showing a chronoamperometry (CA) curve of the electrochemical cell for hydrogen production according to an embodiment of the present invention. It can be seen from FIG. 2 that Operation Example 2, in which pulse operation was performed, improved durability against catalyst poisoning and reduced performance degradation, compared to Operation Example 1 in which the constant voltage operation was performed.

Figure 3:
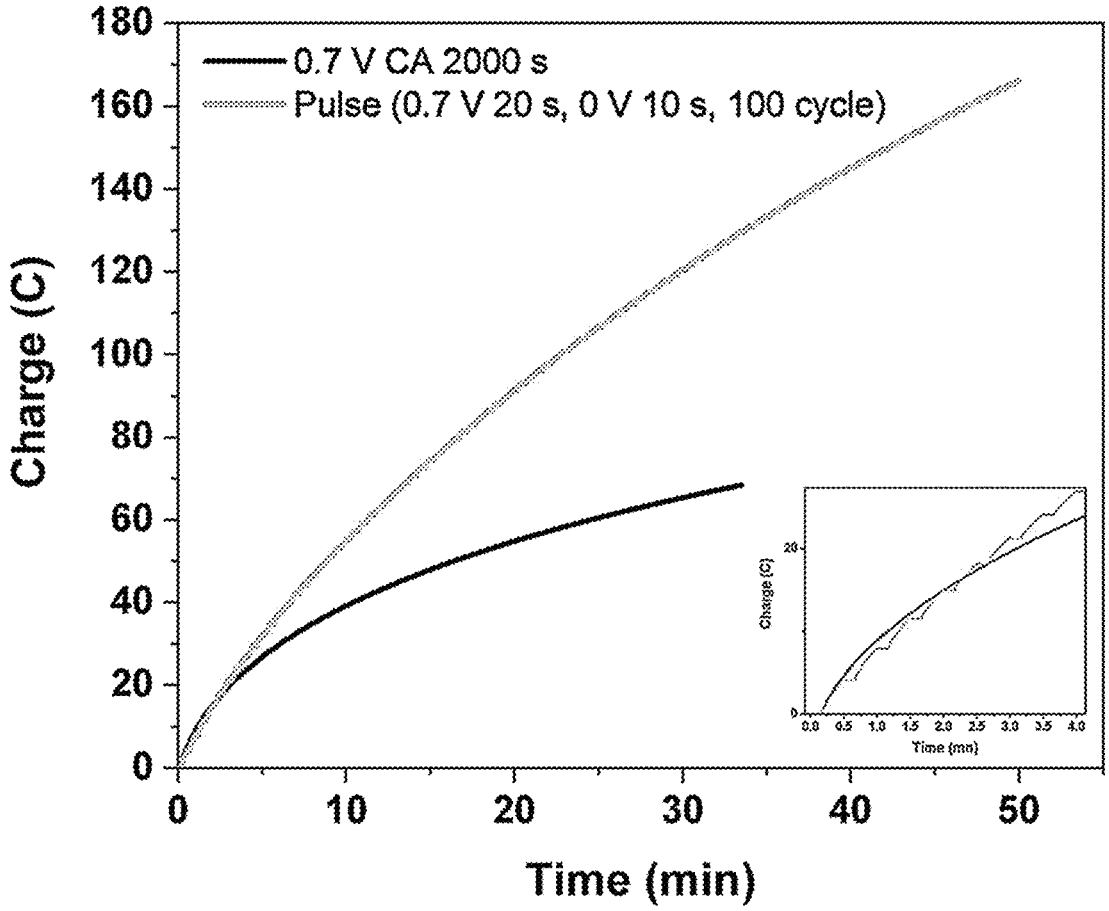
FIG. 3 is a graph showing a change in charge over time of an electrochemical cell for hydrogen production according to an embodiment of the present invention.

Meanwhile, a change in charge of the electrochemical cell for hydrogen production was measured using a potentiostat. FIG. 3 is a graph showing a change in charge over time of the electrochemical cell for hydrogen production according to an embodiment of the present invention. FIG. 3 showed that each of the charges in Operation Example 1 and Operation Example 2 were 68 C and 166 C. It could be confirmed from a current shown by the ammonia oxidation and hydrogen production reaction that Operation Example 2 in which the pulse operation was performed produced 1.6 times more hydrogen per minute compared to Operation Example 1 in which the constant voltage operation was performed (0.42 mL/min, 50 minutes; 0.26 mL/min, 33.3 minutes; 1 atm, 25° C. conditions). The present inventors have demonstrated excellent ammonia electrolysis and hydrogen production performances by the device using such a membrane-electrode assembly.

<Experimental Example 2> Performance Confirmation of Electrochemical Cell for Hydrogen Production 2 (Comparison of Negative Voltage and Positive Voltage)

Figure 4A:
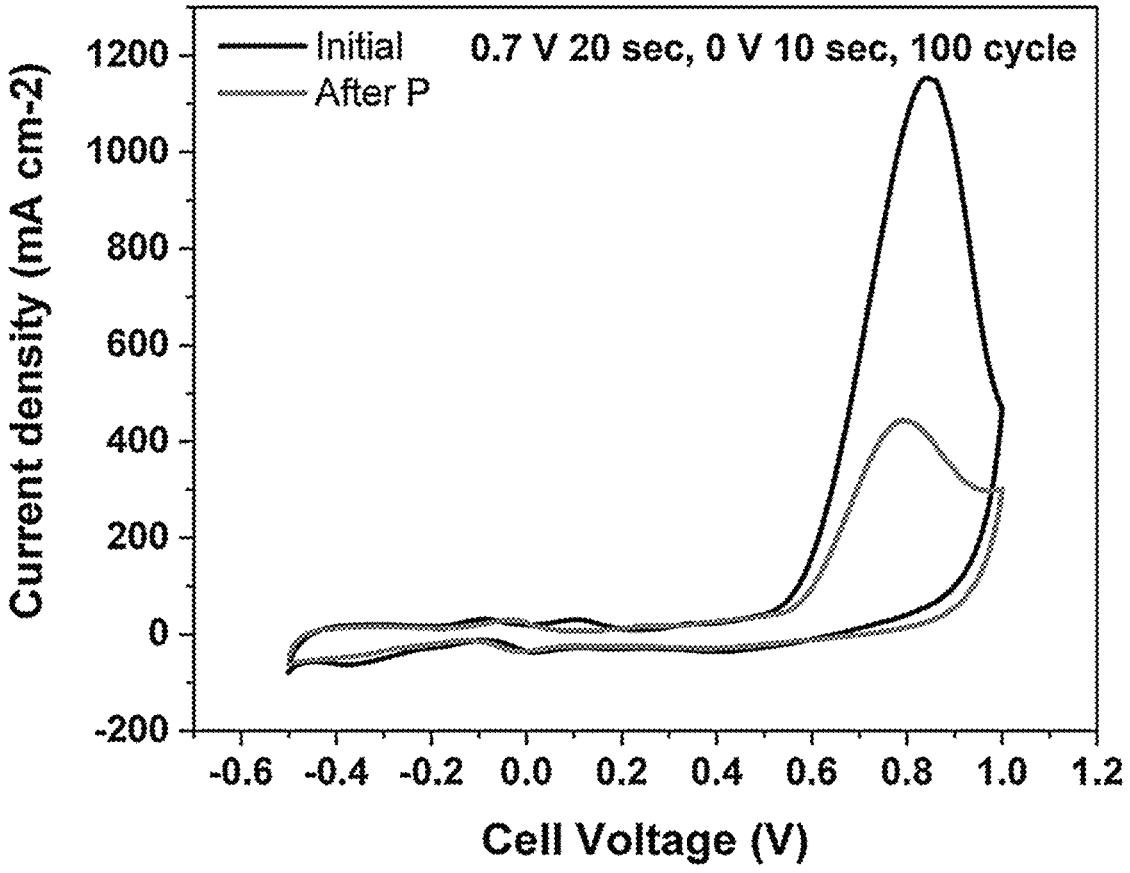
FIGS. 4A and 4B are graphs showing cyclic voltammetry (CV) curves of an electrochemical cell for hydrogen production according to an embodiment of the present invention.
Figure 4B:
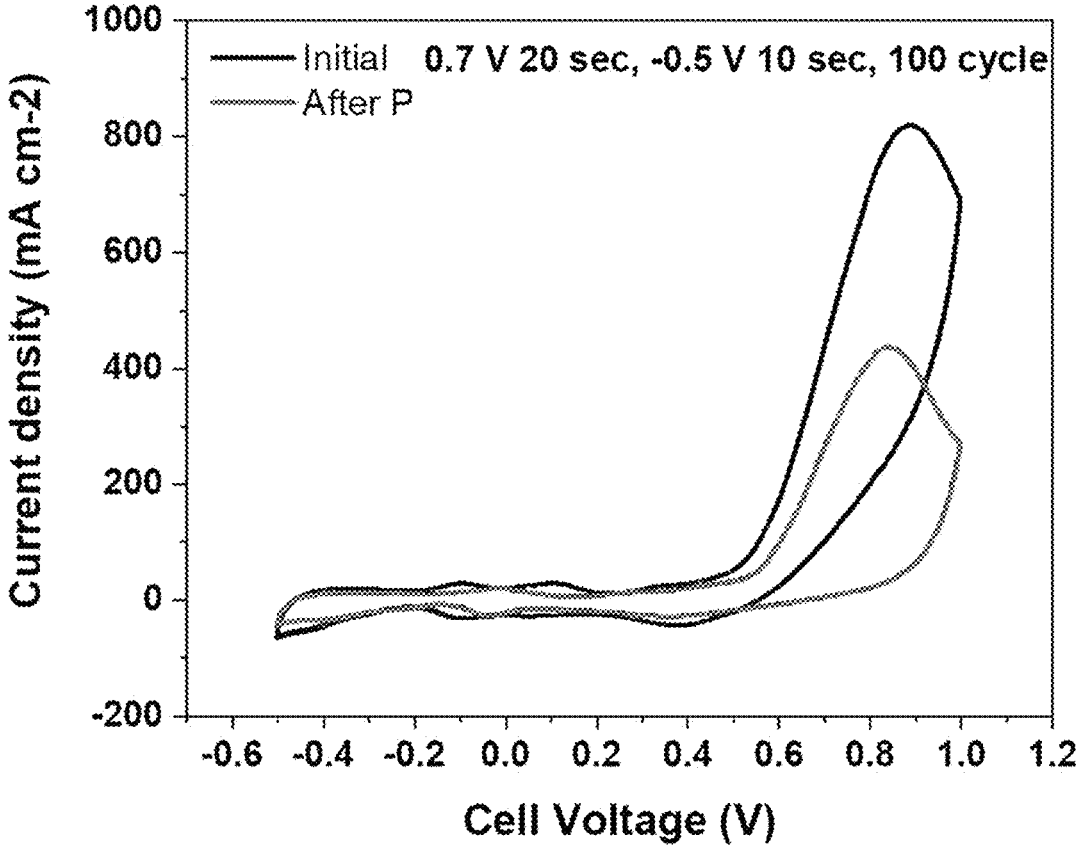
Figure 5A:
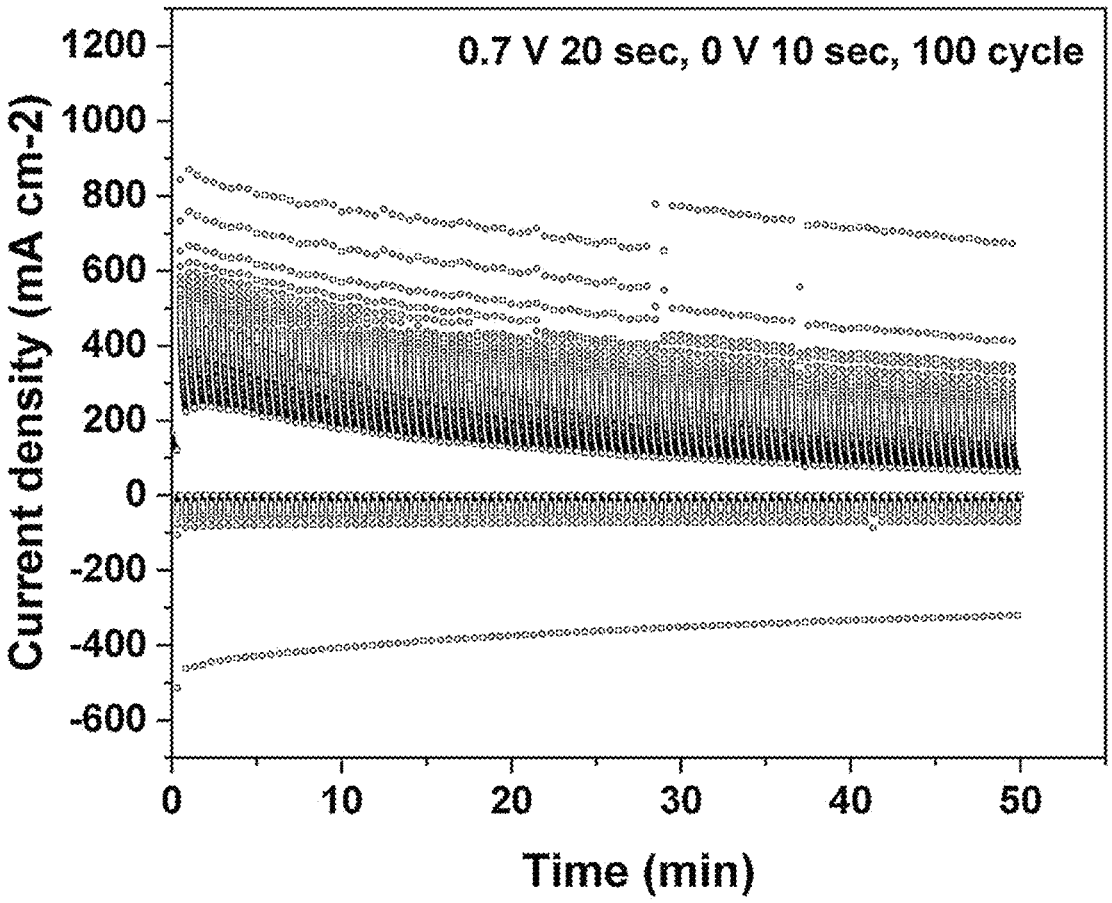
FIGS. 5A and 5B are graphs showing chronoamperometric (CA) curves of an electrochemical cell for hydrogen production according to an embodiment of the present invention.
Figure 5B:
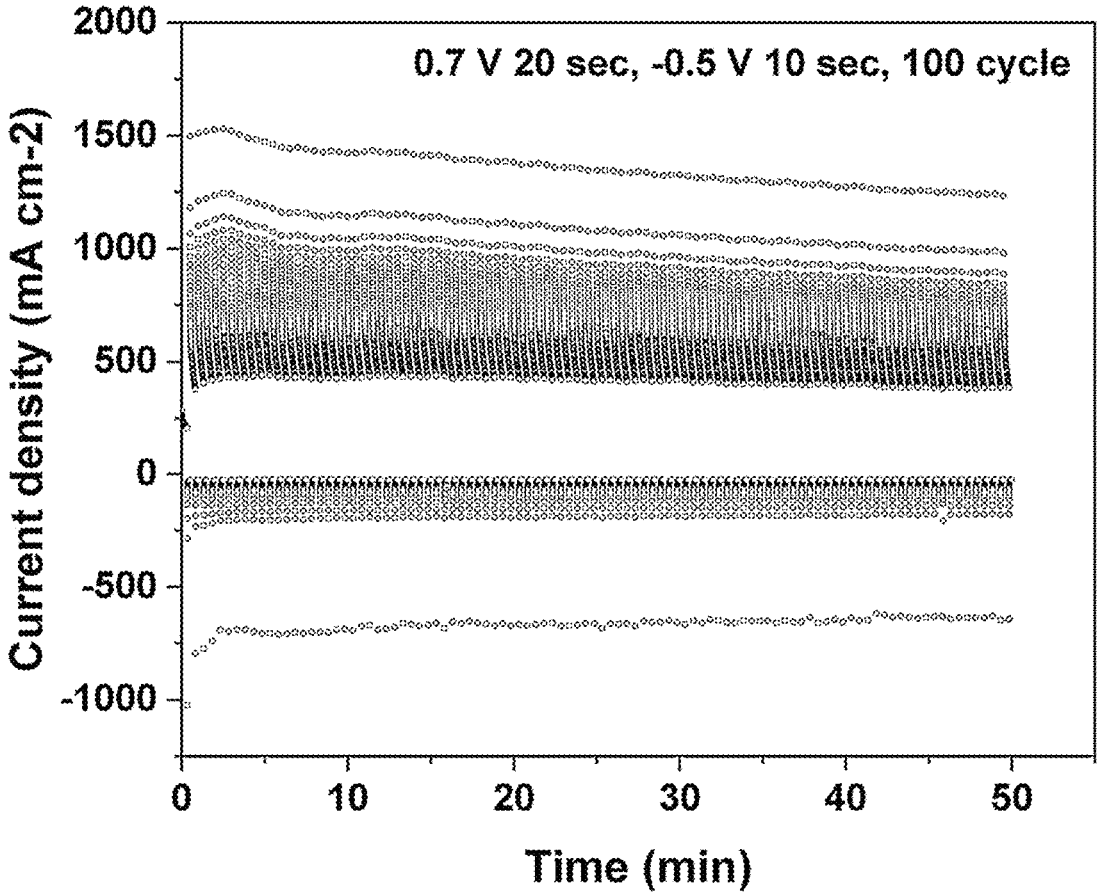

Ammonia electrolysis and hydrogen production performances were confirmed for the electrochemical cells for hydrogen production of Operation Example 2 and Operation Example 3. FIGS. 4A and 4B are graphs showing cyclic voltammetry (CV) curves of the electrochemical cell for hydrogen production according to an embodiment of the present invention. FIGS. 5A and 5B are graphs showing chronoamperometric (CA) curves of the electrochemical cell for hydrogen production according to an embodiment of the present invention. A peak current density and a ratio compared to initial were shown in Table 1 below.

TABLE 1

| Classification | Peak current density (mA $cm^{-2}$) | Ratio compared to initial (%) |
|---|---|---|
| Initial | 1136.6 | 100 |
| After P (0 V) | 480.8 | 42.3 |
| Initial | 819.3 | 100 |
| After P (−0.5 V) | 437.0 | 53.3 |

It could be confirmed from FIGS. 4A and 4B and FIGS. 5A and 5B that Operation Example 3 in which the second potential range is a negative voltage had improved durability against catalyst poisoning and reduced performance degradation before and after the pulse operation, compared to Operation Example 2 in which the second potential range is a positive voltage.

<Experimental Example 3> Performance Confirmation of Electrochemical Cell for Hydrogen Production 3 (Addition of Step of Circulating and Injecting Poison Removal Solution)

Figure 6:
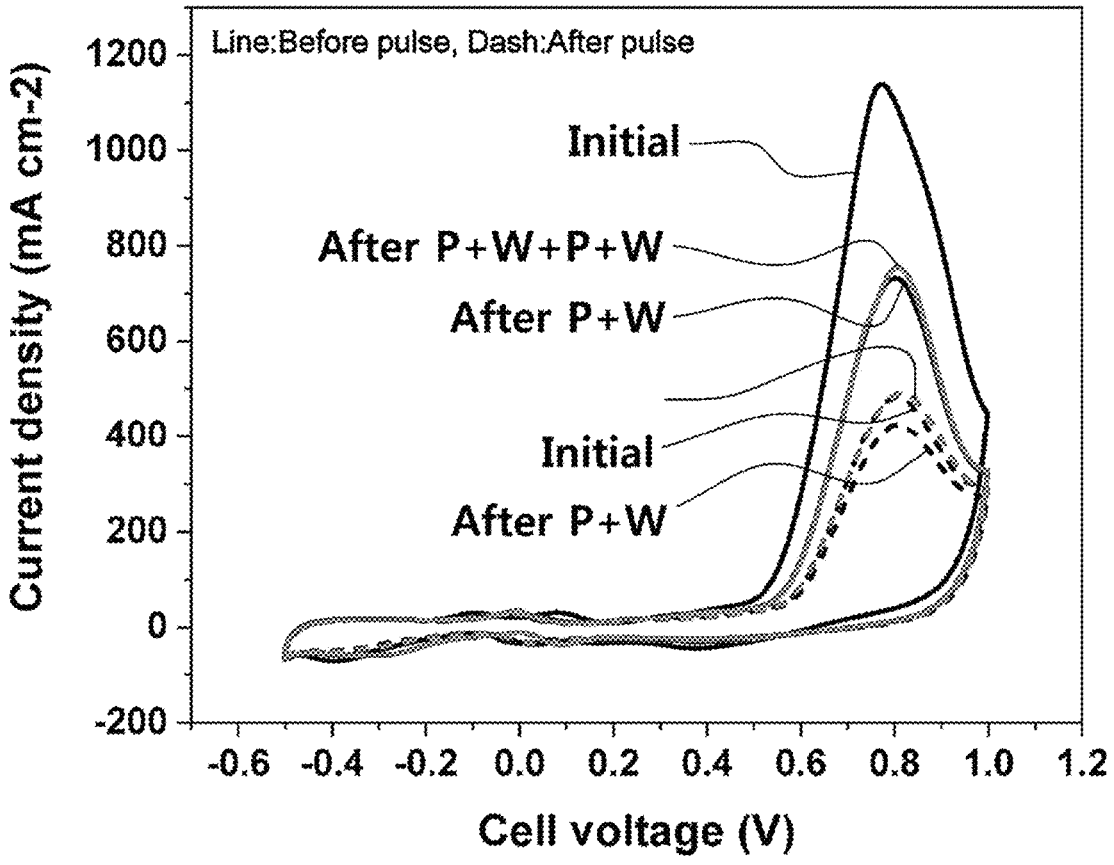
FIG. 6 is a graph showing a cyclic voltammetry (CV) curve of an electrochemical cell for hydrogen production according to an embodiment of the present invention.
Figure 7:
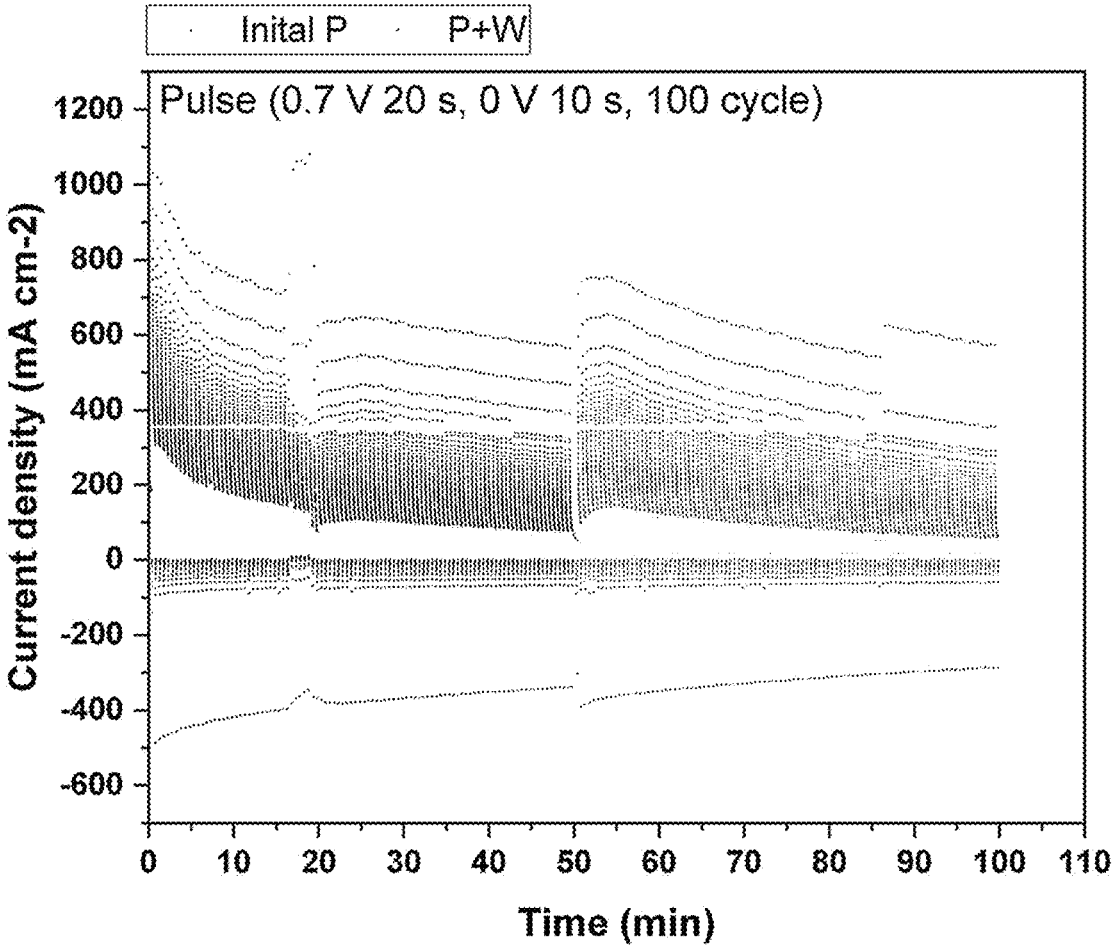
FIG. 7 is a graph showing a chronoamperometric (CA) curve of an electrochemical cell for hydrogen production according to an embodiment of the present invention.

Ammonia electrolysis and hydrogen production performances were confirmed for the electrochemical cell for hydrogen production of Operation Example 2 and the electrochemical cell of Operation Example in which the pulse operation and the circulation and injection of the poisoning removal solution were performed once more. FIG. 6 is a graph showing a cyclic voltammetry (CV) curve of the electrochemical cell for hydrogen production according to an embodiment of the present invention. FIG. 7 is a graph showing a chronoamperometric (CA) curve of the electrochemical cell for hydrogen production according to an embodiment of the present invention. A peak current density and a ratio compared to initial were shown in Table 2 below.

TABLE 2

| Classification | Peak current density (mA $cm^{-2}$) | Ratio compared to initial (%) |
|---|---|---|
| Initial | 1136.6 | 100 |
| After P | 480.8 | 42.3 |
| After P + W | 732.0 | 64.4 |
| After P + W + P | 422.8 | 37.2 |
| After P + W + P + W | 754.7 | 66.4 |

It could be confirmed from FIGS. 6 and 7 that the performance was recovered to about 60% compared to the initial performance through circulation and injection of the poisoning removal solution, and that the same performance was recovered even after additional pulse operation and the circulation and injection.

<Experimental Example 4> Performance Confirmation of Electrochemical Cell for Hydrogen Production 4 (Effect According to Operation Time)

Figure 8A:
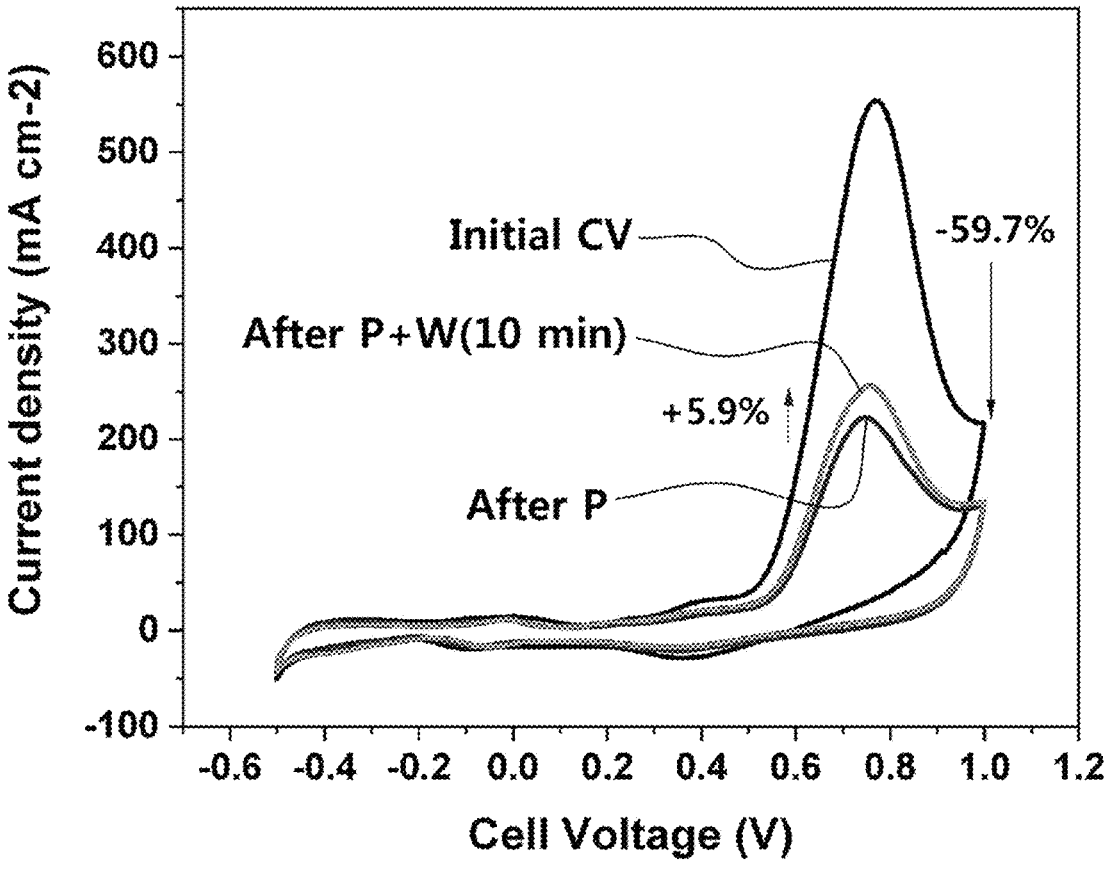
FIGS. 8A, 8B, and 8C are graphs showing cyclic voltammetry (CV) curves of an electrochemical cell for hydrogen production according to an embodiment of the present invention.
Figure 8B:
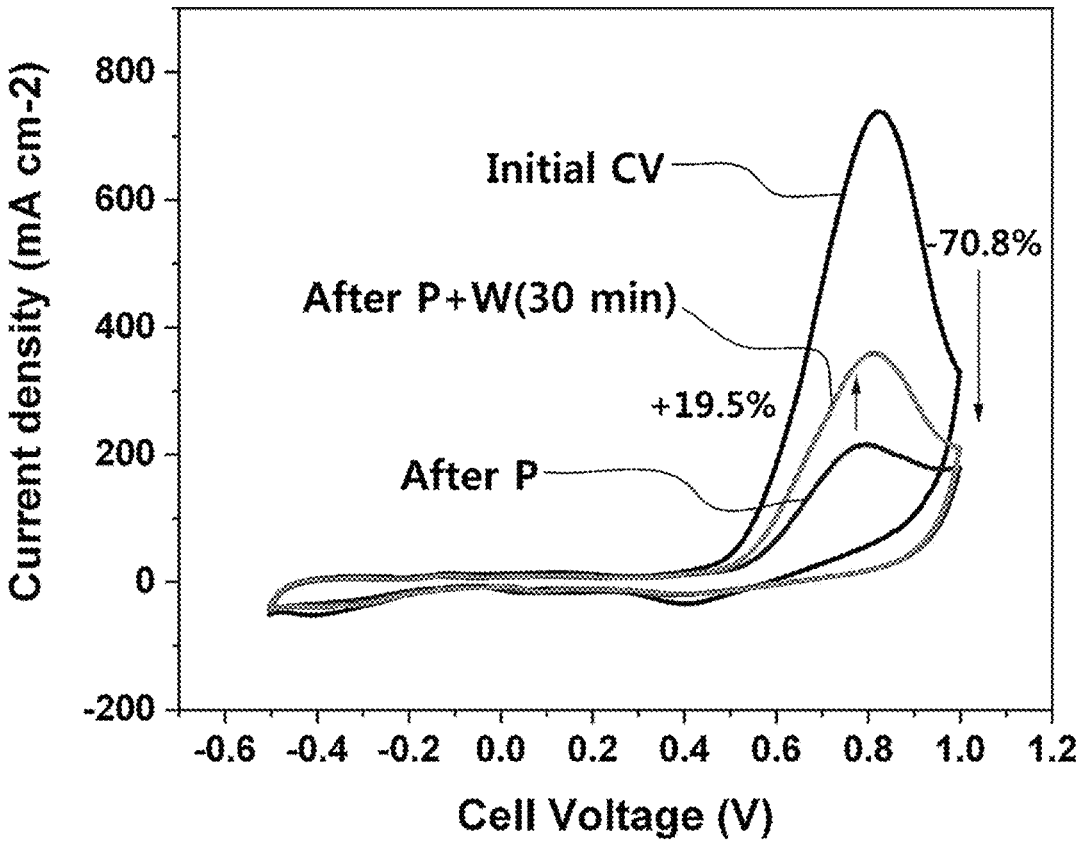
Figure 8C:
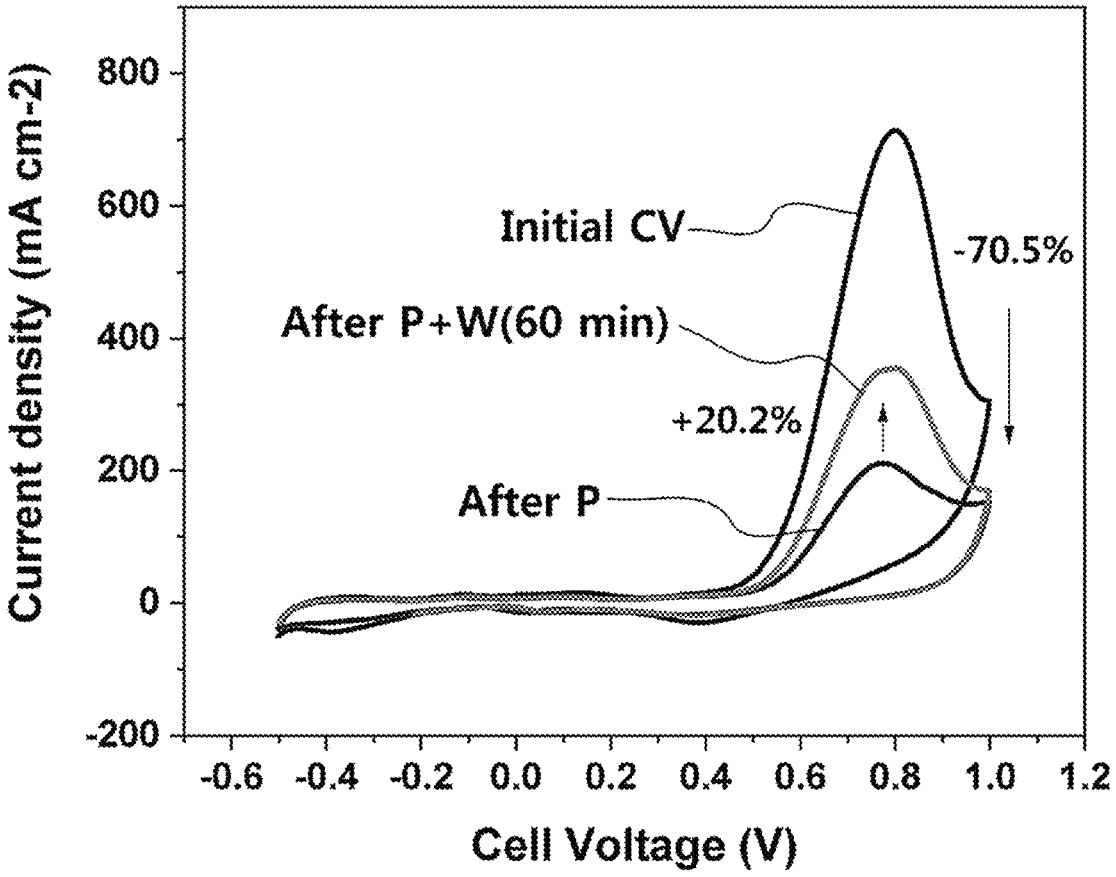
Figure 9:
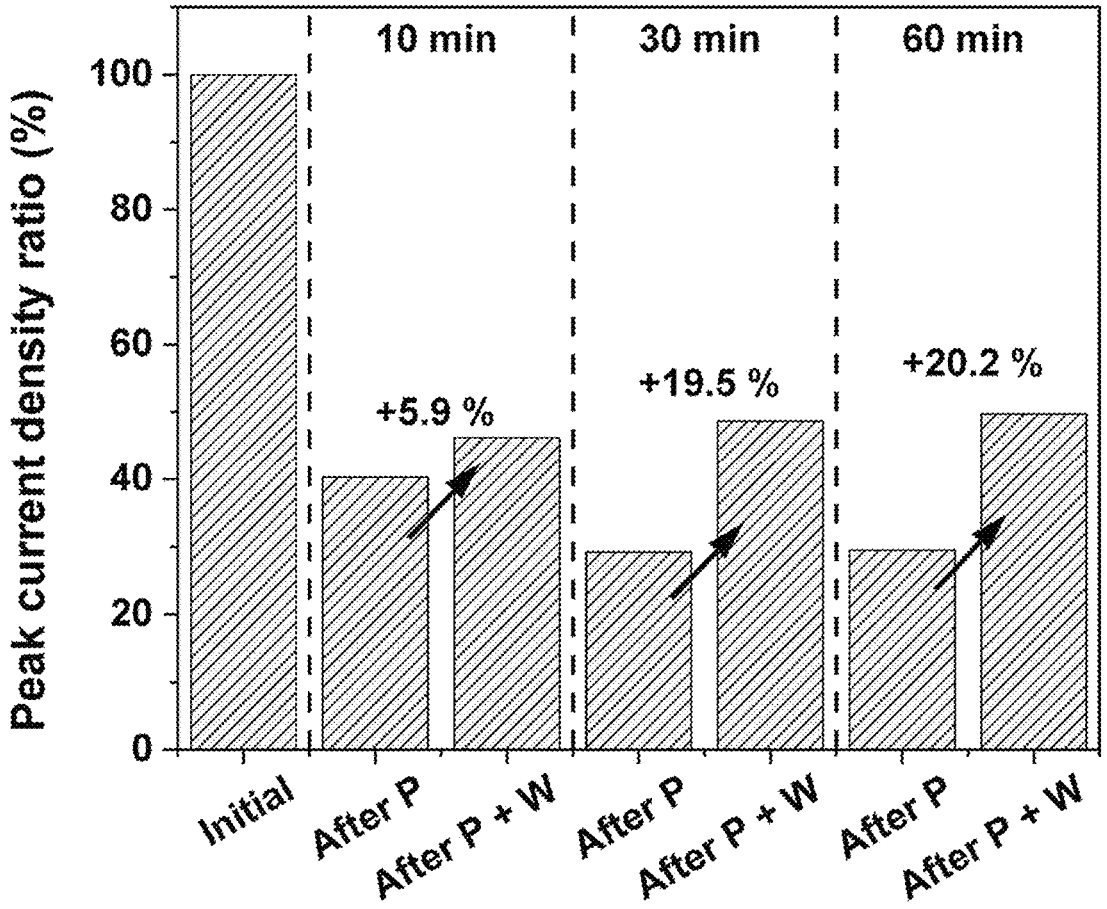
FIG. 9 is a graph showing a change in peak current density ratio over time of an electrochemical cell for hydrogen production according to an embodiment of the present invention.

Ammonia electrolysis and hydrogen production performances were confirmed by varying operation time for the electrochemical cell for hydrogen production of Operation Example 2 to 10 minutes, 30 minutes, and 60 minutes, respectively. FIGS. 8A to 8C are graphs showing cyclic voltammetry (CV) curves of the electrochemical cell for hydrogen production according to an embodiment of the present invention. FIG. 9 is a graph showing a change in a peak current density ratio over time of the electrochemical cell for hydrogen production according to an embodiment of the present invention.

It could be confirmed from FIGS. 8A to 8C and FIG. 9 that when checking the peak current according to the recovering progress time of the poisoned electrode, the performance was recovered up to 30 minutes of distilled water circulation without change in the performance recovery after that.

<Experimental Example 5> Confirmation of Removal of Nitrogen Species from Anode

Figure 10A:
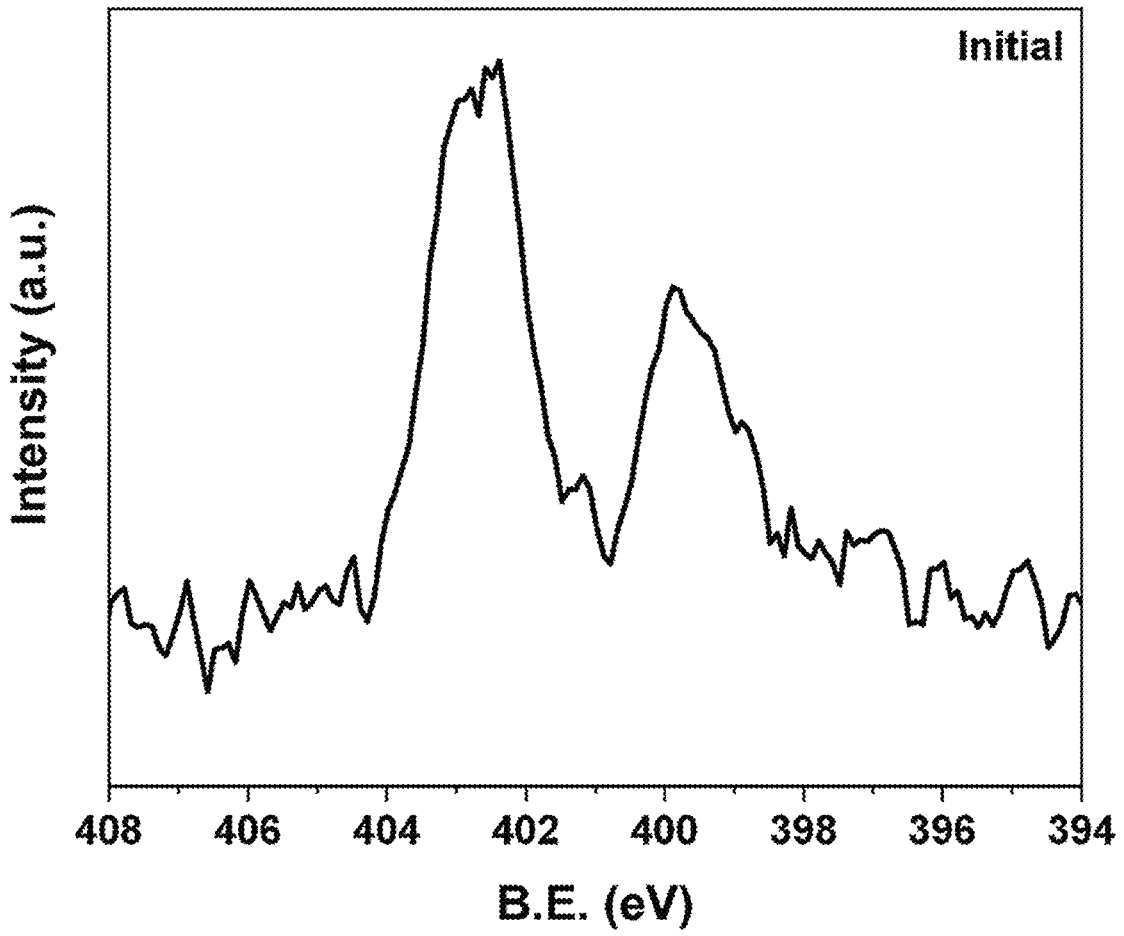
FIGS. 10A, 10B, and 10C are graphs showing N 1 s XPS analysis results of an anode of a membrane electrode assembly for hydrogen production according to an embodiment of the invention.
Figure 10B:
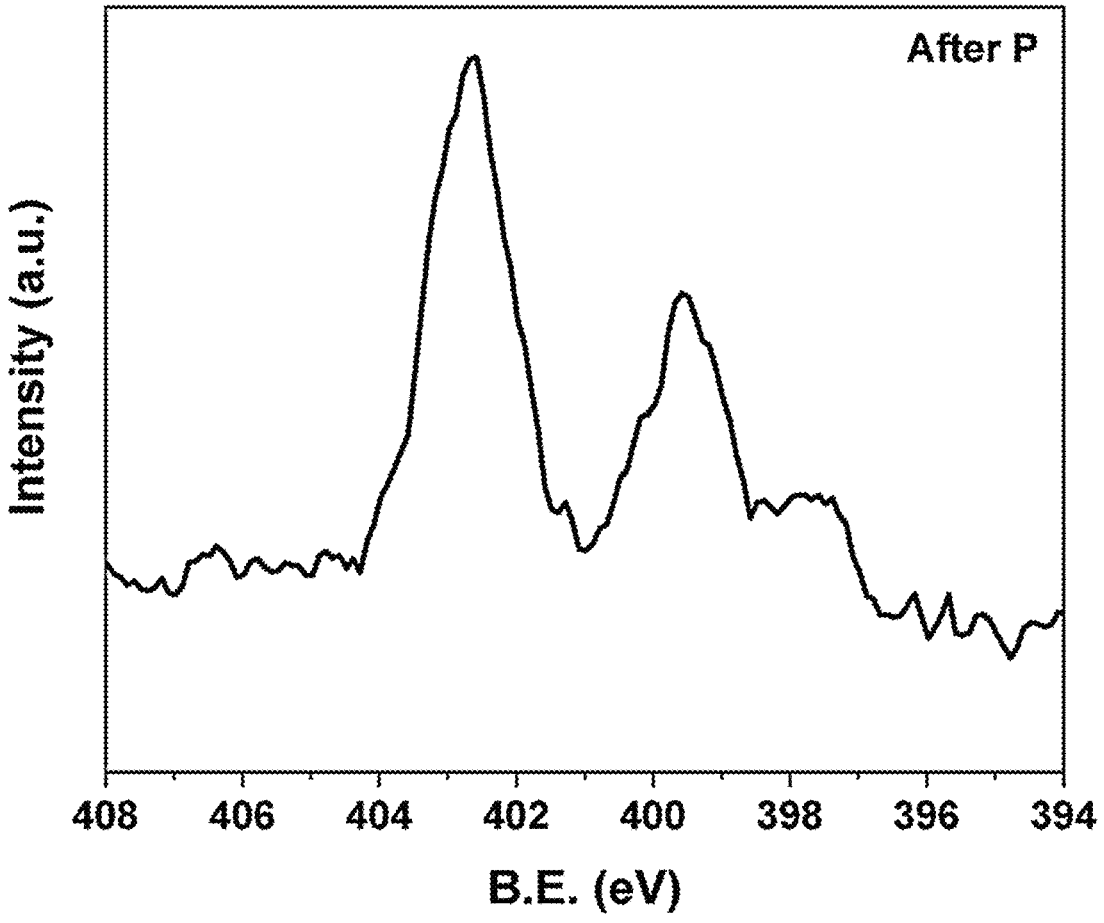
Figure 10C:
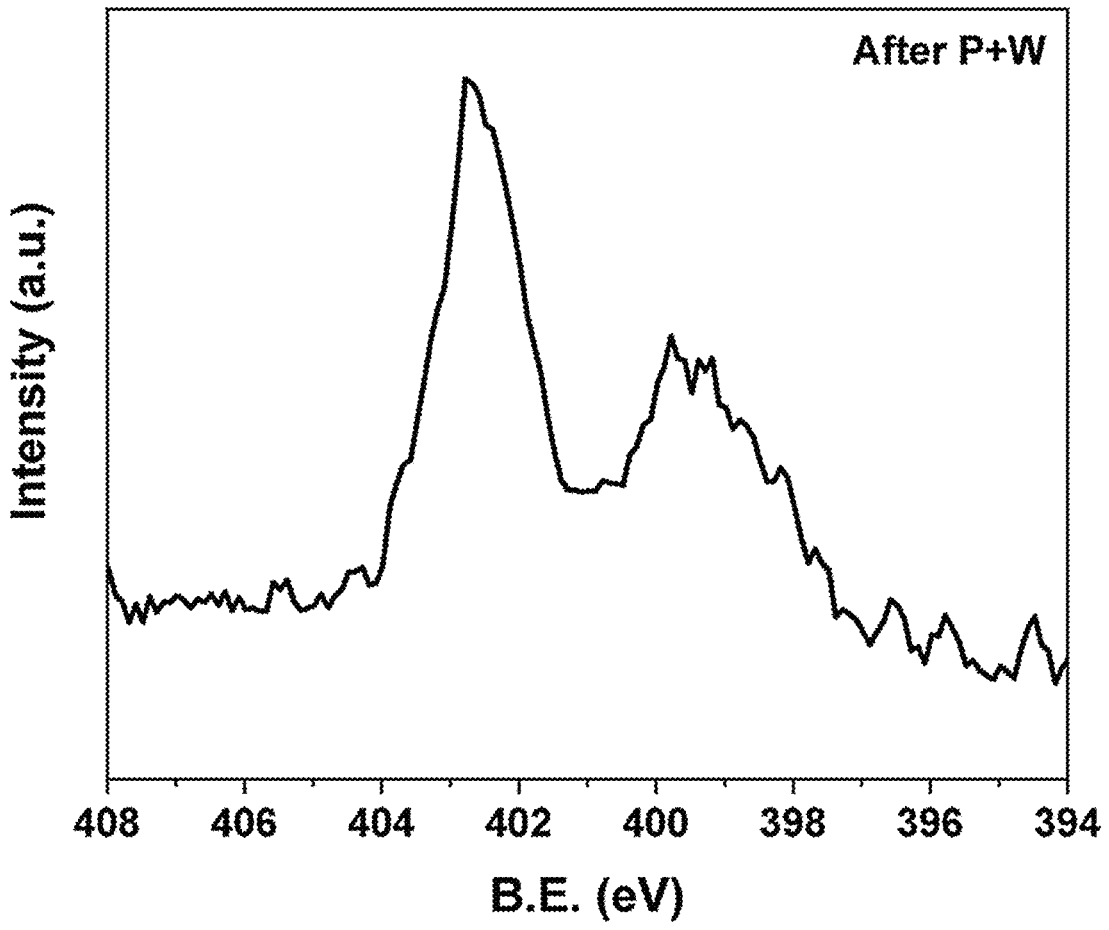

A presence of nitrogen species in the anode was confirmed for the electrochemical cell for hydrogen production. FIGS. 10A to 10C are graphs showing N 1 s XPS analysis results of the anode of the membrane electrode assembly for hydrogen production according to an embodiment of the invention. A N/Pt ratio was shown in Table 3 below.

TABLE 3

| Classification | N/Pt ratio |
|---|---|
| Initial | 0.6/1 |
| After P | 1.5/1 |
| After P + W | 1.2/1 |

It could be confirmed from FIGS. 10A to 10C that a peak was formed at about 398 eV after the pulse operation and was decreased through the performance recovery process, and that the overall N/Pt ratio was also decreased compared to after the pulse operation, which shows removal of the nitrogen species due to Pt surface poisoning.

<Experimental Example 6> Performance Confirmation of Electrochemical Cell for Hydrogen Production 5 (Effect According to Type of Electrolyte)

Figure 11:
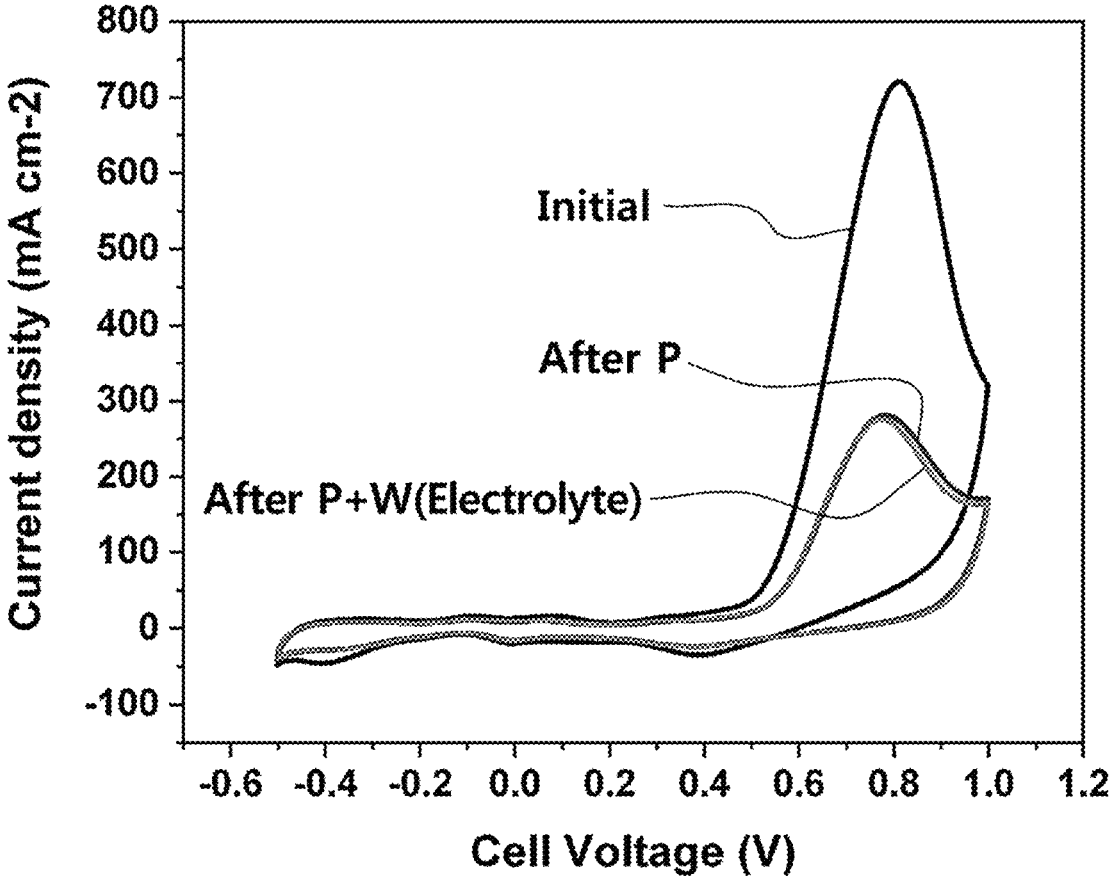
FIG. 11 is a graph showing a cyclic voltammetry (CV) curve of an electrochemical cell for hydrogen production according to an embodiment of the present invention.

Ammonia electrolysis and hydrogen production performances were confirmed by simply circulating the electrolyte used in the anode and the cathode, respectively, instead of distilled water, for the electrochemical cell for hydrogen production of Operation Example 2. FIG. 11 is a graph showing a cyclic voltammetry (CV) curve of the electrochemical cell for hydrogen production according to an embodiment of the present invention.

It could be confirmed from FIG. 11 that the performance was not recovered by simply circulating the electrolyte used in the anode and the cathode into the ammonia electrolysis device whose performance has been decreased after the pulse operation.

<Experimental Example 7> Performance Confirmation of Electrochemical Cell for Hydrogen Production 6

Figure 12:
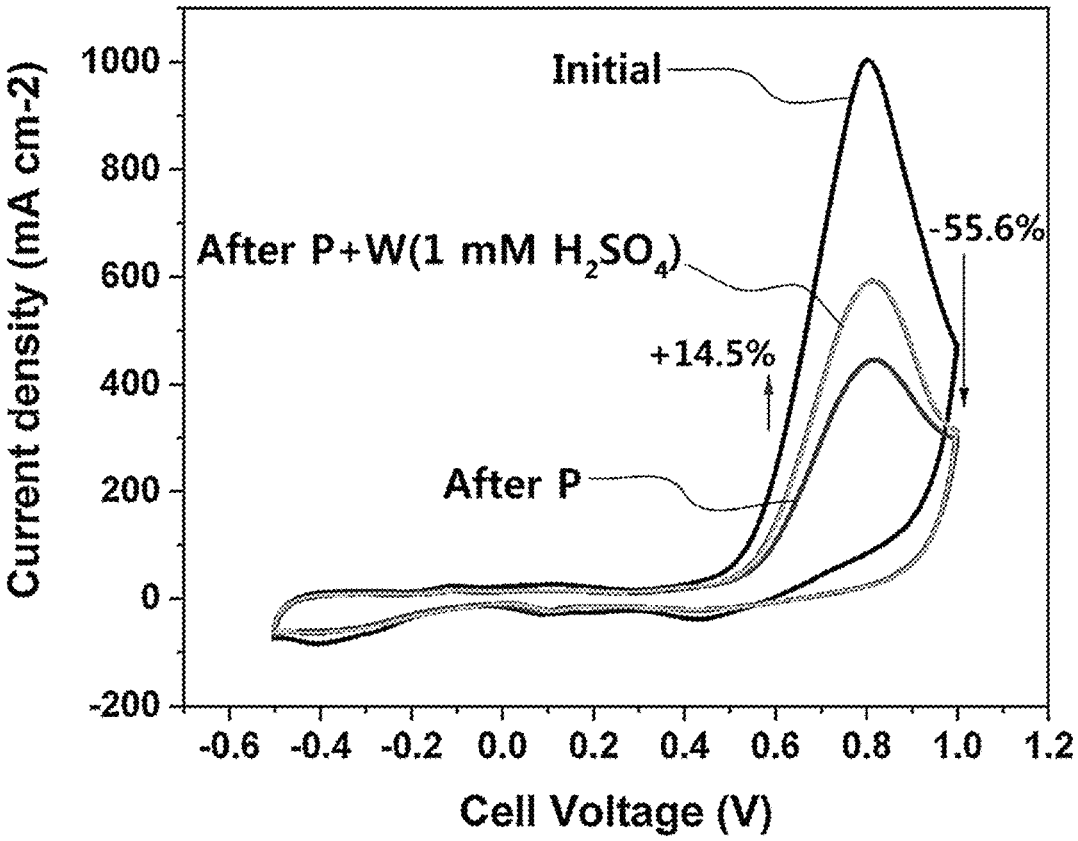
FIGS. 12 and 13 are graphs showing cyclic voltammetry (CV) curves of an electrochemical cell for hydrogen production according to an embodiment of the present invention.
Figure 13:
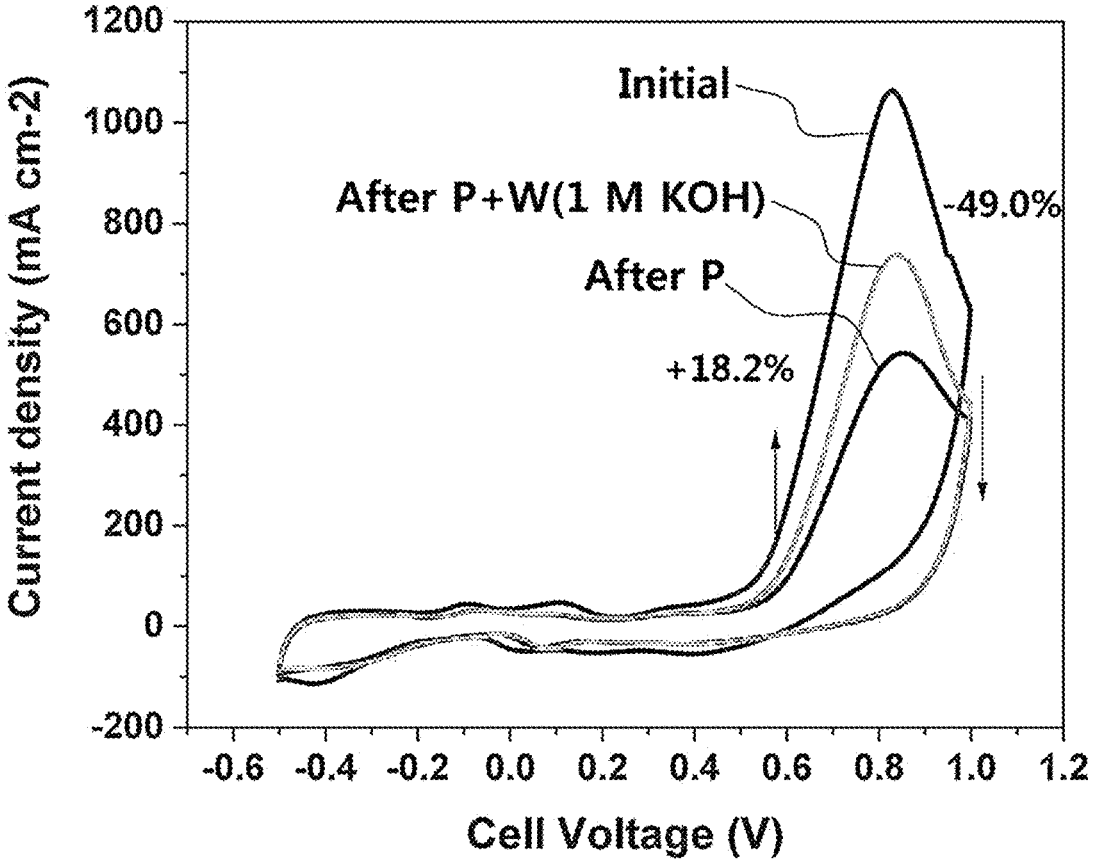

Ammonia electrolysis and hydrogen production performances were confirmed by circulating a sulfuric acid of 1 mM or KOH of 1M, respectively, instead of distilled water, for the electrochemical cell for hydrogen production of Operation Example 2. FIGS. 12 and 13 are graphs showing cyclic voltammetry (CV) curves of the electrochemical cell for hydrogen production according to an embodiment of the present invention.

It could be confirmed from FIGS. 12 and 13 that when the sulfuric acid electrolyte of 1 mM or the KOH electrolyte of 1M was circulated as a poisoning removal solution, the performance was recovered by 14.5% and 18.2%, respectively, compared to the peak current after the poisoning.

<Experimental Example 8> Performance Confirmation of Electrochemical Cell for Hydrogen Production 7 (Addition of Step of Applying Cycling Voltage)

Figure 14:
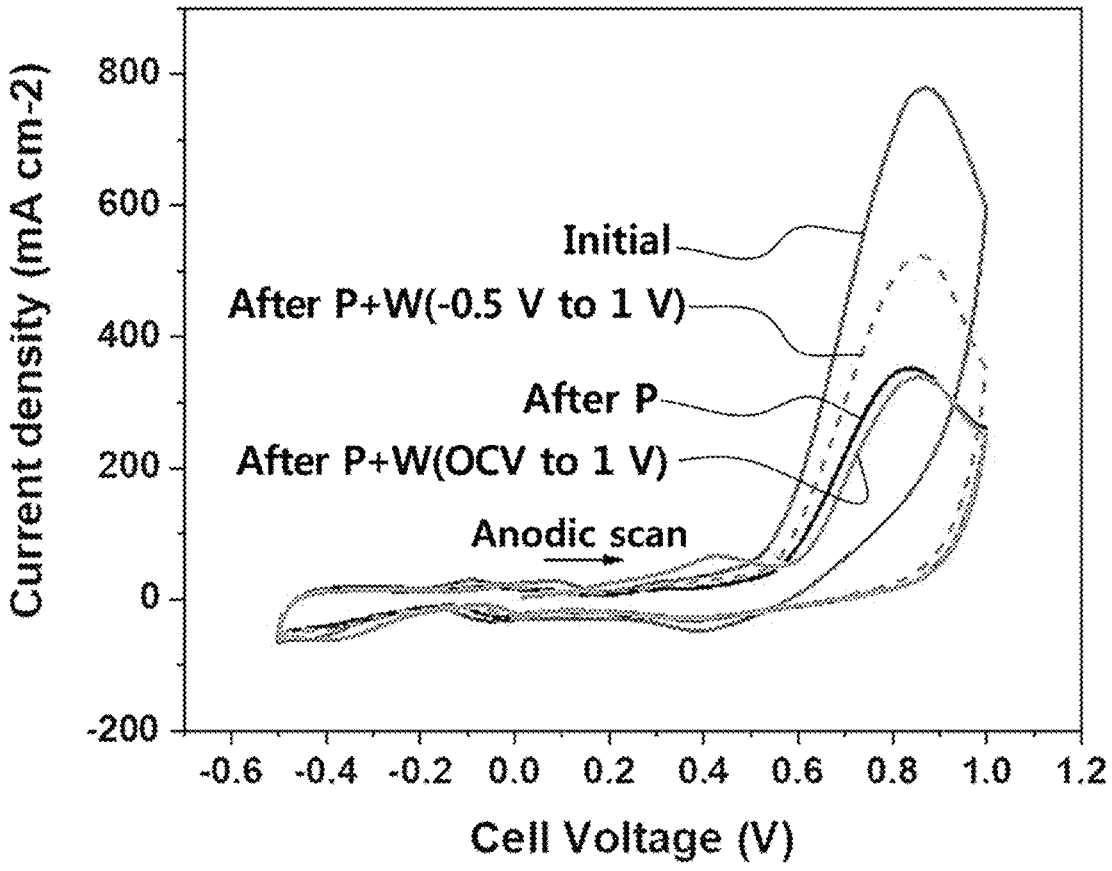
FIGS. 14 and 15 are graphs showing cyclic voltammetry (CV) curves of an electrochemical cell for hydrogen production according to an embodiment of the present invention.
Figure 15:
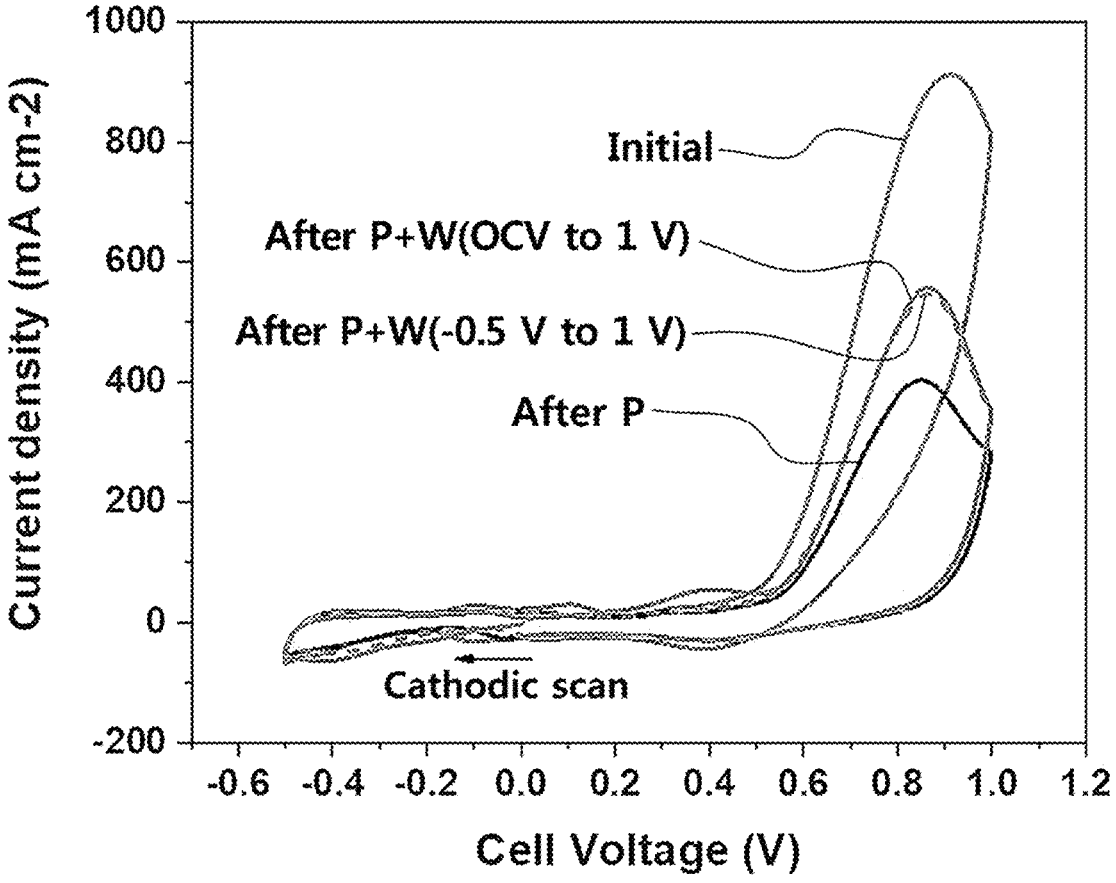

Ammonia electrolysis and hydrogen production performances were confirmed by circulating and injecting a poisoning removal solution for the electrochemical cell for hydrogen production of Operation Example 2 followed by applying a cycling voltage with a current-voltage control device. FIGS. 14 and 15 are graphs showing cyclic voltammetry (CV) curves of the electrochemical cell for hydrogen production according to an embodiment of the present invention. FIG. 14 is the results of carrying out an anodic scan of OCV, 1 V, −0.5 V, and 1 V, and FIG. 15 is the results of carrying out a cathodic scan of OCV, −0.5 V, and 1 V.

It could be confirmed from FIGS. 14 and 15 that when the ammonia oxidation reaction (AOR) was performed by increasing a voltage in the positive (+) direction after the circulation process, the peak current density was similar to a poisoned state after the pulse operation, but the peak current density of the ammonia oxidation reaction (AOR) was recovered after reduction to a low voltage of −0.5 V.

Although exemplary embodiments of the present invention have been described above in relation to the above-mentioned preferred Examples, various modifications and variations can be made without departing from the gist and scope of the invention. Accordingly, the attached claims will cover such modifications and variations as long as they fall within the spirit of the present invention.

What is claimed is:

1. A method for hydrogen production, comprising the steps of:

delivering ammonia to an anode of the electrochemical cell for hydrogen production;

oxidizing the ammonia at the anode to decompose it into water, nitrogen, and electrons;

transferring the electrons from the anode to a cathode; and producing substantially pure hydrogen by the electrons at the cathode, and further comprising the step of performing pulse operation by applying a constant voltage to the anode by a current-voltage control device, after performing the pulse operation, further comprising the step of circulating and injecting a poisoning removal solution that prevents poisoning of the anode catalyst into the anode by a cycling injection device, wherein the pulse operation is repeatedly performed when an average potential of the electrochemical cell for hydrogen production is in the range of 0.5V to 0.9V and −1.0V to 0V, wherein the electrochemical cell comprises a membrane electrode assembly comprises:

an anion exchange membrane;

a cathode located on one side of the anion exchange membrane; and an anode located on the other side of the anion exchange membrane, wherein the anode includes an alkaline electrolyte containing an aqueous ammonia solution and an anode catalyst, and further comprising a current-voltage control device that performs pulse operation by applying a constant voltage to the anode.

2. The method for hydrogen production according to claim 1, wherein the anode catalyst is a catalyst for ammonia oxidation reaction (AOR), and the anode catalyst contains one or more metals selected from the group consisting of platinum (Pt), iridium (Ir), rhodium (Rh), ruthenium (Ru), iron (Fe), cobalt (Co), nickel (Ni), and copper (Cu).

3. The method for hydrogen production according to claim 1, wherein the pulse operation is repeatedly performed when an average potential of the electrochemical cell for hydrogen production is in a positive voltage range and a negative voltage range.

4. The method for hydrogen production according to claim 1, wherein the pulse operation is repeatedly performed for 10 to 30 seconds when an average potential of the electrochemical cell for hydrogen production is in the range of 0.5V to 0.9V, and is repeatedly performed for 5 to 15 seconds when the average potential is in the range of −1.0V to 0V.

5. The method for hydrogen production according claim 1, wherein the poisoning removal solution is basic, neutral, or acidic and does not contain ammonia.

6. The method for hydrogen production according to claim 1, wherein the step of performing the pulse operation is performed one or more times.

7. The method for hydrogen production according to claim 1, wherein the step of performing the pulse operation and the step of circulating and injecting the poisoning removal solution are performed one or more times.

8. The method for hydrogen production according to claim 1, further comprising the step of applying a cycling voltage to the anode by the current-voltage control device after the step of circulating and injecting the poisoning removal solution, wherein the cycling voltage includes a negative reduction voltage.

* * * * *